United States Patent [19]

Christiansen

[11] 4,016,455

[45] Apr. 5, 1977

[54] STATIC ELIMINATOR

[75] Inventor: Robert W. Christiansen, Amery, Wis.

[73] Assignee: Minnesota Mining and Manufacturing Company, St. Paul, Minn.

[22] Filed: Oct. 22, 1975

[21] Appl. No.: 624,940

[52] U.S. Cl. ..... 361/222

[51] Int. Cl.[2] ..... H01T 19/04

[58] Field of Search ..... 317/2 R, 2 F, 3, 4, 317/262 R, 262 A; 250/324–326

[56] References Cited

UNITED STATES PATENTS

| | | | |
|---|---|---|---|
| 2,392,808 | 1/1946 | Chapman | 317/2 F |
| 3,283,209 | 11/1966 | Schutz | 317/2 F |
| 3,443,155 | 5/1969 | Schweriner | 317/2 F |
| 3,887,843 | 6/1975 | Richardson et al. | 317/2 F |

*Primary Examiner*—Harry Moose

*Attorney, Agent, or Firm*—Cruzan Alexander; Donald M. Sell; William L. Huebsch

[57] ABSTRACT

A structure affording ease of manufacture and assembly for a static eliminator of the type including an insulated conductor adapted for attachment to a source of high alternating voltage and a plurality of conductive members disposed along the cable insulation and including outwardly projecting needles capacitively coupled to the conductor to afford neutralization of static electrical charges in an area adjacent the needles. The conductive members are formed from a single thin piece of sheet metal and each comprises a channel generally U-shaped in cross section and having an inner surface adapted to engage the periphery of the insulation, with the needle being a U-shaped portion of the sheet metal bent to project away from the channel .

7 Claims, 5 Drawing Figures

STATIC ELIMINATOR

BACKGROUND OF THE INVENTION

1. Field of the Invention

This invention relates to structures for static eliminating devices.

2. Description of the Prior Art

Static eliminators of the type known as shockproof static eliminators are well known in the art. Typically they comprise a cable having a central conductor adapted to be connected to a source of high alternating voltage (e.g. 4,000–12,000 volts), and a thick electrically insulating sleeve around the cable. Also included are a plurality of conductive members disposed in axially spaced relationship along a portion of the cable, each consisting of a cylindrical electrically conductive band around the insulating sleeve and a conductive needle electrically connected to the band and projecting generally radially outwardly from the cable. The conductive bands capacitively couple the needles to the source of alternating voltage so that ions are formed around the needles. These ions will neutralize static electrical charges adjacent the needles.

In one known embodiment the needles are pressed radially through the walls of the bands to provide electrical and mechanical engagement therebetween. This embodiment requires bands having a substantial wall thickness to mechanically support the needles, however, which results in a static eliminator of an undesirably large diameter for some applications. Also, the insertion of the needles in the bands during production presents a problem due to the difficulty of handling, positioning and pressing in the small needles.

In another known embodiment the conductive band is a vapor coated layer around the insulating sleeve and the static eliminator comprises a thick layer of electrically insulating material around the vapor coated band. The needles are pressed through the insulating material into electrical contact with the vapor coated band so that the insulating layer mechanically supports the needle. While this construction affords a static eliminator of a small physical diameter, it still requires handling and pressing of small individual needles to assemble the static eliminator.

SUMMARY OF THE INVENTION

A static eliminator structure according to the present invention eliminates the need to handle, position and press individual needles during assembly thereof, thereby greatly simplifying the assembly of the static eliminator, while the structure still affords construction of static eliminators having a very small diameter (e.g. less than ½ inch or 1.27 cm diameter).

According to the present invention there is provided a static eliminator generally of the typs previously described, except that the conductive members are of an improved design. In the present invention each conductive member comprises a thin walled open sided channel generally U-shaped in cross section and having a needle projecting generally outwardly from an outer surface of the channel. While it may be possible to attach the needle to the channel by conventional automated production procedures used in the manufacture of thumb tacks, preferably the needle and channel are formed as by stamping from a single piece of sheet metal, with the needle being a generally V-shaped portion of the sheet metal bent to project outwardly of the portion of said sheet metal curved to form the channel.

Such channels having an inner surface area of over 50 square millimeters have been found to provide satisfactory capacitive coupling with the conductor in a cable carrying an alternating voltage potential of 4,000 – 12,000 volts (nominally 7,000 volts). Preferably the conductive members are formed of stainless steel which appears to have greater corrosion resistance when used in the static eliminator than do copper alloys.

Also preferably the conductive members according to the present invention are attached along the cable by means comprising an elongate clip formed of a flexible resilient electrically insulating material. The clip comprises a curved wall having a generally C-shaped cross section adapted to be positioned over the cable and the conductive members, and having longitudinally spaced openings for receiving the needles of the conductive members to space and position the conductive members along the clip and thereby along the cable. The clip may also have longitudinal outwardly projecting ribs which will engage the inner surface of an outer conductive tube which provides an electrically grounded shield for the static eliminator, and thereby properly position within the tube the somewhat flexible cable portion to which the conductive members are attached. Such positioning can be important to restrict electrical breakdown of the insulating sleeve and arcing from the conductor to the grounded tube or arcing from the conductive members to the tube, particularly where the static eliminator is of a minimum size.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENTS

Figure 1:
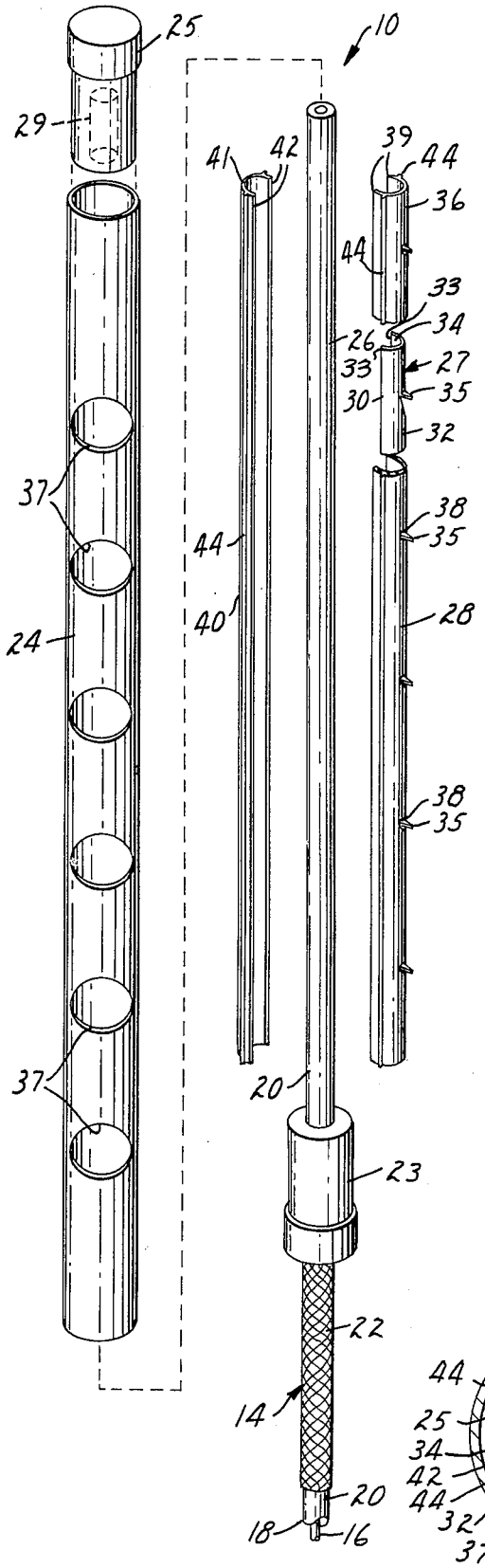
FIG. 1 is an exploded view of a first embodiment of a static eliminator according to the present invention.

Referring now to FIGS. 1 through 4 of the drawing there is illustrated a first embodiment of a static eliminator according to the present invention, generally designated by the numeral 10. The static eliminator 10 is of the type designated "shockproof" and is adapted to be positioned adjacent a surface (such as that of a web 12 illustrated in FIG. 3) to neutralize static electrical charges thereon.

As is best seen in FIG. 1, the device 10 comprises a cable 14 including a central conductor 16 adapted for connection at one end 18 to a source of high alternating voltage (not shown), and a thick electrically insulating sleeve 20 around the conductor 16.

The cable 14 may also include an outer conductive shield 22 providing a portion of electrical shield means for the static eliminator adapted to be electrically connected to a source of ground potential (not shown) to prevent fields produced by the alternating voltage in the conductor 16 from interfering with equipment in which the static eliminator 10 is positioned. The shield means also includes an electrically conductive plug 23 to which the shield 22 is electrically connected (as by solder), and a cylindrical rigid electrically conductive tube 24 electrically connected to the conductive plug 23 as by a screw (not shown) extending between the conductive plug 23 and an end plug 25 of electrically insulating material.

The cable 14 passes through a central opening in the electrically conductive plug 23 and an end portion 26 of the cable 14 from which the shield 22 is removed projects a predetermined distance past the conductive plug 23 and terminates in a central socket 29 in the electrically insulating end plug 25.

A plurality of conductive members 27 are spaced along and attached to the periphery of the end portion 26 of the cable 14 by means comprising an elongate clip 28 formed of a flexible resilient electrically insulating material.

Figure 2:
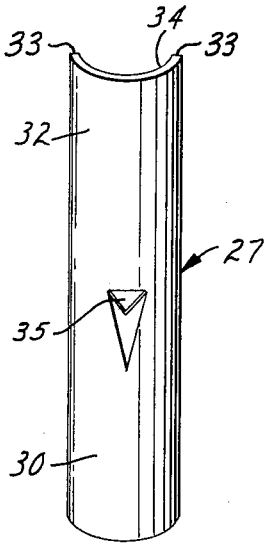
FIG. 2 is an enlarged view of one of a plurality of conductive members in the static eliminator illustrated in FIG. 1.
Figure 3:
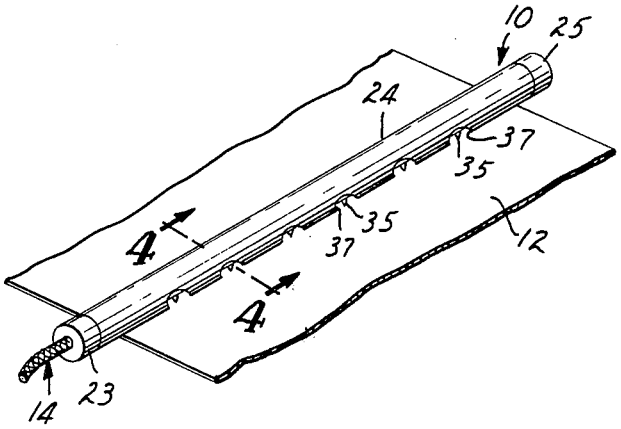
FIG. 3 is a reduced perspective view of the static eliminator of FIG. 1 positioned over a web from which static electrical charges are being removed.
Figure 4:
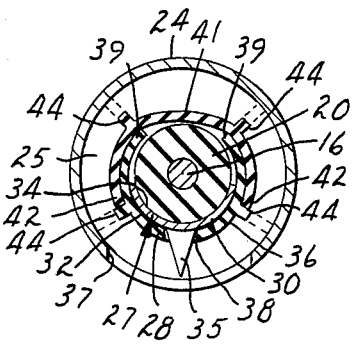
FIG. 4 is an enlarged sectional view taken approximately along line 4—4 of FIG. 3.

As is best seen in FIG. 2, each of the conductive members 27 is formed of a single thin sheet of electrically conductive metal and includes a thin walled channel 30 generally U-shaped or half cylindrical in cross section, having an outer surface 32, an inner surface 34 conforming to the outer cylindrical peripheral surface of the insulating sleeve, and opposed axially extending edges 33 along junctures of the inner and outer surfaces 34, 32 which edges 33 are spaced to afford free movement of the inner surface 34 of the channel 30 into engagement with the cable 14 in a direction radial of the cable 14 20. Each conductive member 27 also includes a needle-like portion or needle 35 projecting outwardly from the outer surface 32. The needle 35 is generally centrally located a generally V-shaped portion of the sheet of metal bent to project outwardly of the portions of the sheet of metal forming the channel 30, and is disposed to project generally radially away from the cable 14 when the inner surface 34 of the channel 30 is disposed coaxially along the insulating sleeve 20.

The clip 28 comprises a curved wall 36 having a generally C-shaped or semicircular cross section. The curved wall 36 has aligned openings 38 spaced at predetermined positions axially of the clip 28. The openings 38 are adapted so that they will receive the needles 35 of the conductive members 27 to space the conductive members 27 at predetermined desired spacings and align the needles 35 axially along the cable end portion 26. The spacing and alignment of the needles 35 are adapted to align their longitudinal axis generally centrally within circular apertures 37 through and spaced along the tube 24. Opposed end portions 39 of the flexible curved wall 36 are spaced so that during assembly of the static eliminator 10 the conductive members 27 may be positioned along the inner surface of the clip 28 with the needles 35 positioned through the opening 38. Subsequently the clip 28 carrying the conductive members 27 may be moved transversely over the end portion 26 of the cable 14 to position the conductive members 27 thereon.

The means for attaching the conductive members 27 to the periphery of the cable end portion 26 also include a second elongate clip 40 which like the clip 28 is also formed of a flexible resilient electrically insulating material and comprises a curved wall 41 having a generally C-shaped or semicircular cross section with opposed end portions 42. The opposed end portions 42 or 39 of one of the curved walls 41 or 36 are resiliently spread and frictionally engage the opposed end portions 42 or 39 of the curved walls 41 or 36 to retain the clips 28 and 40 in engagement around the cable end portion 26.

In addition to attaching the conductive members 27 the engaged clips 28 and 40 also provide support for the relatively flexible end portion 26 of the cable 14 between the plugs 23 and 25. Both clips 28 and 40 have longitudinally extending ribs 44 adapted to add to their rigidity in transverse bending. If a very precise position of the cable end portion 26 is required within the tube 24, these ribs 44 can be formed with a height radially of the cable end portion 26 (shown in dotted outline for the static eliminator 10 in FIG. 4) so that they will bear against the inner surface of the tube 24.

Figure 5:
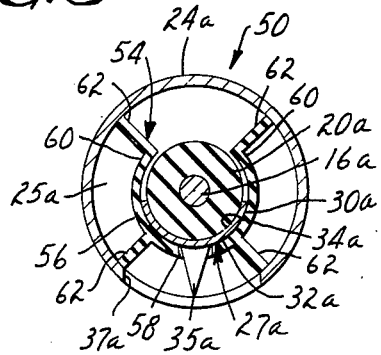
FIG. 5 is a sectional view generally corresponding to FIG. 4, but illustrating an alternative form of means for attaching conductive members to a cable and for positioning them within a shield in a static eliminator according to the present invention.

FIG. 5 is a section of an alternate embodiment of a static eliminator according to the present invention, generally designated by the numeral 50, and in which parts similar to those of the static eliminator 10 are similarly numbered except for the addition of the suffix *a*. The static eliminator 50 has a structure very similar to that of the static eliminator 10, including a cable **14*a* with a central conductor 16*a*, an insulating sleeve 20*a* on which are supported a plurality of conductive members 27*a* at an end portion 26*a* of the cable 14*a* between a conductive plug (not shown) and an end plug 25*a* and positioned within a rigid conductive tube 24*a* between the plugs. The difference between the static eliminator embodiments 50 and 10 is in the means by which the conductive members 27*a* are attached to, spaced and aligned along the end portion 26*a* of the cable 14*a*. In the static eliminator 50, these means consist of a single clip 54 of flexible resilient electrically insulating material having a curved wall 56 of generally semicircular or C-shaped cross sections having longitudinally spaced openings 58 adapted to receive the needles 35*a* of the conductive members 27*a* to provide spacing and alignment therefore. The clip 54 is adapted to resiliently engage the cable 14*a* with opposed end portions 60 of the curved wall 56 resiliently biasing the inner surfaces of the conductive members 27*a* into engagement with the projecting end portion 26*a* of the cable 14*a*. The clip 54 also has four circumferentially spaced longitudinally extending ribs 62 which add to the rigidity of the clip 54 in transverse bending and have a height radially of the cable end portion 26*a* so that they will bear against the inner surface of the rigid tube 24*a*. This structure positively supports and accurately positions the cable end portion 26*a* within the rigid tube 24*a*** which is particularly desirable for static eliminators of a minimum size.

During assembly the opposed end portions 60 of the curved wall 56 may be manually spread by using the ribs 62 adjacent thereto as levers to afford insertion of the conductive members **27*a* therealong with their needles 35*a* in the openings 58. Subsequently similar resilient spreading of the opposed wall end portions 60 affords movement of the clip 54 carrying the conductive members 27*a* transversely over the end portion 26*a*** of the cable 14*a* to its position engaged therewith to attach the conductive members 27*a* thereto.

I claim:

1. A static eliminator comprising:

a cable including a central conductor adapted for connection to a source of alternating high potential and a thick cylindrical insulating sleeve around the conductor;

a plurality of conductive members each including an elongate thin walled channel generally half-cylindrical in cross section, said channel having an outer surface, an inner surface conforming to the outer surface of said insulating sleeve, opposed axially extending edges along junctures of said inner and outer surfaces which edges are spaced to afford free movement of the inner surface of the channel into engagement with the cable in a direction radial of said cable, and a needle connected to said channel and projecting outwardly from said outer surface, said needle being disposed to project generally radially away from said cable when the inner surface of said member is disposed against said insulating sleeve; and an elongate clip formed of a flexible resilient electrically insulating material having a curved wall generally C-shaped in cross section, said curved wall having axially spaced openings adapted to receive the needles of said conductive members with said channels spaced axially along the clip, and said clip being positioned over the channels of said conductive members with said needles in said openings and over said cable with the opposed ends of said wall in engagement with said cable to releasably retain said clip and said conductive members in spaced relationship axially along said cable with the inner surfaces of said conductive members contacting the outer surface of said insulating sleeve.

2. A static eliminator according to claim 1, wherein the inner surface of the channel of each of said conductive members has an area of at least 50 square millimeters.

3. A static eliminator according to claim 1, wherein the channel and needle of each of said conductive members are formed from the same piece of sheet metal with said needle being a generally V-shaped portion of said sheet metal bent to project outwardly of the portion of said sheet metal curved to form said channel.

4. A static eliminator according to claim 1, wherein said means for securing said conductive members to said cable further comprises a second elongate clip of a flexible resilient electrically insulating material comprising a curved wall with a generally C-shaped cross section, the curved wall of said second clip being positioned around the side of said cable opposite said clip formed with said openings with opposed end portions of the curved walls of said clips engaging each other.

5. A static eliminator according to claim 1, wherein said static eliminator further comprises a rigid conductive tube around said portion of said cable and said conductive members, said tube having an aperture positioned around the longitudinal axis of each of said needles; and said clip has longitudinally extending radially outwardly projecting ribs adapted to engage the inner surface of said tube to position said cable portion and conductive members within said shield.

6. A static eliminator comprising:

a cable including a central conductor adapted for connection to a source of alternating high potential and a thick cylindrical insulating sleeve around the conductor;

a plurality of conductive members each formed from a single piece of sheet metal and including an elongate thin walled channel generally half-cylindrical in cross section, said channel having an outer surface, an inner surface of at least 50 square millimeters conforming to the outer surface of said insulating sleeve, opposed axially extending edges along junctures of said inner and outer surfaces which edges are spaced to afford free movement of the inner surface of the channel into engagement with the cable in a direction radial of said cable, and a needle projecting outwardly from said outer surface, said needle being a generally centrally located V-shaped portion of said sheet metal bent to project outwardly of the portion of said sheet metal forming said channel and disposed to project generally radially away from said cable when the inner surface of said conductive member is disposed against said insulating sleeve; and an elongate clip formed of a flexible resilient electrically insulating material having a curved wall generally C-shaped in cross section, said curved wall having axially spaced openings adapted to receive the needles of said conductive members with said channels spaced axially along the clip, and said clip being positioned over the channels of said conductive members with said needles in said openings and over said cable with the opposed ends of said wall in engagement with said cable to releasably retain said clip and said conductive members in spaced relationship axially along said cable with the inner surfaces of said conductive members contacting the outer surface of said insulating sleeve.

7. A static eliminator according to claim 6, wherein said static eliminator further comprises a rigid conductive tube around said portion of said cable and said conductive members, said tube having an aperture positioned around the longitudinal axis of each of said needles; and said clip has longitudinally extending radially outwardly projecting ribs adapted to engage the inner surface of said tube to position said cable portion and conductive members within said shield.

* * * * *